US006073781A

United States Patent [19]

Puglisi

[11] Patent Number: 6,073,781

[45] Date of Patent: Jun. 13, 2000

[54] RACK FOR HOLDING ELONGATED ARTICLES

[76] Inventor: Kenneth Lee Puglisi, 6225 Rte. 88, Finleyville, Pa. 15332

[21] Appl. No.: 09/119,698

[22] Filed: Jul. 21, 1998

Related U.S. Application Data

[63] Continuation-in-part of application No. 09/056,735, Apr. 7, 1998, abandoned.

[51] Int. Cl.[7] ..... A47F 7/00

[52] U.S. Cl. ..... 211/70.6; 211/60.1

[58] Field of Search ..... 211/70.6, 4, 60.1; 224/402, 403, 405, 547, 401, 404, 575, 400

[56] References Cited

U.S. PATENT DOCUMENTS

| | | | |
|---|---|---|---|
| 475,720 | 5/1892 | Colby . | |
| 505,799 | 9/1893 | Brown . | |
| 672,561 | 4/1901 | Loeb . | |
| 732,089 | 6/1903 | Lenzen . | |
| 734,091 | 7/1903 | Porteck . | |
| 763,461 | 6/1904 | Burton . | |
| 862,729 | 8/1907 | Goldsmith . | |
| 867,996 | 10/1907 | McMillan . | |
| 914,563 | 3/1909 | Fowler . | |
| 961,234 | 6/1910 | Hoover . | |
| 1,077,513 | 11/1913 | Eagleson . | |
| 1,139,940 | 5/1915 | Westmoreland | 211/4 |
| 1,204,813 | 11/1916 | Murray . | |
| 1,221,584 | 4/1917 | Patrick . | |
| 1,235,267 | 7/1917 | Wheary . | |
| 2,041,749 | 5/1936 | Fischer . | |
| 2,321,339 | 6/1943 | Wadsworth . | |
| 2,588,110 | 3/1952 | Halliday . | |
| 2,667,274 | 1/1954 | Diebold . | |
| 2,708,522 | 5/1955 | Loomis | 211/7 |
| 2,865,430 | 12/1958 | Folkner . | |
| 2,935,202 | 5/1960 | Doerwald . | |
| 2,946,452 | 6/1960 | Caloiero et al. | 211/4 |
| 2,987,192 | 6/1961 | Metzler et al. | 211/4 |
| 3,204,774 | 9/1965 | Barbieri | 211/4 |
| 3,289,851 | 12/1966 | Federman . | |
| 3,291,317 | 12/1966 | Bowen | 211/4 |
| 3,428,282 | 2/1969 | Pernice | 218/201 |
| 3,432,133 | 3/1969 | Schmid . | |
| 3,438,506 | 4/1969 | Groth . | |
| 3,567,034 | 3/1971 | Mozelsio . | |
| 3,876,076 | 4/1975 | Hazelhurst . | |
| 3,893,568 | 7/1975 | Lile . | |
| 3,964,603 | 6/1976 | Sandler . | |
| 3,980,217 | 9/1976 | Yochum . | |
| 4,009,853 | 3/1977 | Lile . | |
| 4,027,798 | 6/1977 | Swaim . | |
| 4,596,334 | 6/1986 | Daulton . | |
| 4,696,405 | 9/1987 | Waring . | |
| 4,805,781 | 2/1989 | Tegel . | |
| 4,923,103 | 5/1990 | Sauber . | |
| 5,287,972 | 2/1994 | Saathoff . | |
| 5,361,611 | 11/1994 | Hisler . | |
| 5,372,287 | 12/1994 | Deguevara . | |
| 5,647,489 | 7/1997 | Bellis, Jr. . | |

FOREIGN PATENT DOCUMENTS

| | | |
|---|---|---|
| 681952 A5 | 12/1978 | Switzerland . |
| 14886 | of 1911 | United Kingdom . |
| 2 024 003 | 1/1980 | United Kingdom . |

*Primary Examiner*—Daniel P. Stodola
*Assistant Examiner*—Erica B. Harris
*Attorney, Agent, or Firm*—Cohen & Grigsby, P.C.

[57] ABSTRACT

A rack stand that includes an outer member (12) having slots (44 and 46) and that cooperates in sliding engagement with an inner member (14) that is connected to pins (88 and 90). Member (12), which has angularly oriented panels (16 and 18), is placed together and aligned with member (14), which has angularly oriented panels (60 and 62). Pins (88 and 90) are placed through slots (44 and 46) and secured to panels (60 and 62) such that the pins cooperate with slots (44 and 46) to maintain outer and inner members (12 and 14) in assembly. Alternatively, a support arm (102) cooperates with a pin (116) to support tools and ladders.

19 Claims, 4 Drawing Sheets

RACK FOR HOLDING ELONGATED ARTICLES

This is a continuation-in-part of application(s) Ser. No. 09/056,735 filed on Apr. 7, 1998, now abandoned.

BACKGROUND OF THE INVENTION

1. Field of the Invention

The subject invention generally relates to racks for holding elongated items and, more particularly, to mobile racks that will hold and secure elongated tools such as lawn and garden tools and ladders.

2. Description of the Prior Art

In the prior art, many types and styles of racks have been applied to a multitude of purposes. Some of these devices are intended for stationary use such as in storing or displaying items of apparel or athletic equipment. Examples are shown in U.S. Pat. Nos. 763,461; 1,204,813; 1,221,584; 4,696,405; 4,805,781; and 5,287,972. Other types of racks have been intended for mobile applications such as in storing or transporting tools and implements such as shown in U.S. Pat. Nos. 3,876,076; 3,893,568; 3,980,217; 4,027,798; and 5,647,489.

In the basic operation of many of these racks, two cooperating members that are slidingly engaged are selectively moveable between two positions. In one position, the rack is open and the article for which the rack is intended can be moved into or out of the rack. In the alternative position, the rack is closed and the article is secured therein so that no additional articles can be added. Examples are found in U.S. Pat. No. 867,996 (handbags); U.S. Pat. No. 1,204,813 (Indian clubs); U.S. Pat. No. 2,041,749 (grease guns); U.S. Pat. No. 3,876,076 (fishing rods); U.S. Pat. No. 3,964,603 (rings); and U.S. Pat. No. 4,805,781 (eyeglasses).

In some instances, a spring has been used to bias the two moveable parts toward a particular position. For example, U.S. Pat. No. 763,461 shows a spring for biasing a vertical garment hanger in a closed position and U.S. Pat. No. 3,567,034 shows a spring that biases a horizontal garment hanger in the closed position.

In some cases, these prior art devices have worked well for their intended use, but have been designed for use with particular articles such that they are incompatible for use with other articles having dissimilar shape or qualities. For example, U.S. Pat. No. 1,204,813 concerns a rack that is intended for use with Indian clubs. This rack would be incompatible for use with ladders.

In the prior art, some portable racks had been developed specifically for use with shaft-mounted tools and other elongated items. An example is shown in U.S. Pat. No. 5,647,489 which is directed to use with motorized string trimmers. Unfortunately, such racks that are known in the prior art have been found to be mechanically complex and are therefore sometimes difficult to operate as well as relatively expensive to build and maintain.

Accordingly, there was a need in the prior art for a portable rack that would accommodate shaft-mounted tools and similar elongated items, but that was mechanically simpler and easier to operate than prior art racks that were intended for use with such articles.

SUMMARY OF THE INVENTION

In accordance with the present invention, a rack stand includes first and second members that cooperate in sliding relationship to establish open and closed positions for the rack stand. The first member has two rectangular plates that are joined in angular relationship with each plate having at least one slot. A support arm is connected to the first member adjacent to each slot in one of the rectangular plates. The second member also has two rectangular plates that are joined in angular relationship. Pins are connected to each rectangular plate of the second member. The pins extend through the slots on both panels of the first member, the pins cooperating with the edges of the slots to maintain the first and second members together. The pins connected to one of the plates of the second member also cooperate with the support arms to hold articles placed into the rack.

Preferably, the first and second members are placed laterally together before the pins that are to be connected to at least one plate of the second member are secured thereto. After the first and second members are placed together, the pins that are to be connected to the plate are inserted through slots in the first member and then secured to the plate of the second member.

More preferably, the pins have substantially the same lateral thickness as the lateral dimension of the slots so that the pins and sides of the slots cooperate to maintain the first and second members in close proximity.

Also preferably, one end of the support arm defines a recessed groove and one of the pins engages the recessed groove to retain articles on the support arm.

More preferably, the plates of the first and second members respectively define an included angle of substantially 90 degrees.

Other details, objects and advantages of the present invention will become apparent as the following descriptions of a presently preferred embodiment proceeds.

BRIEF DESCRIPTION OF THE DRAWINGS

A preferred embodiment of the disclosed invention is shown and described in connection with accompanying drawings wherein.

DESCRIPTION OF THE PREFERRED EMBODIMENT

Figure 1:
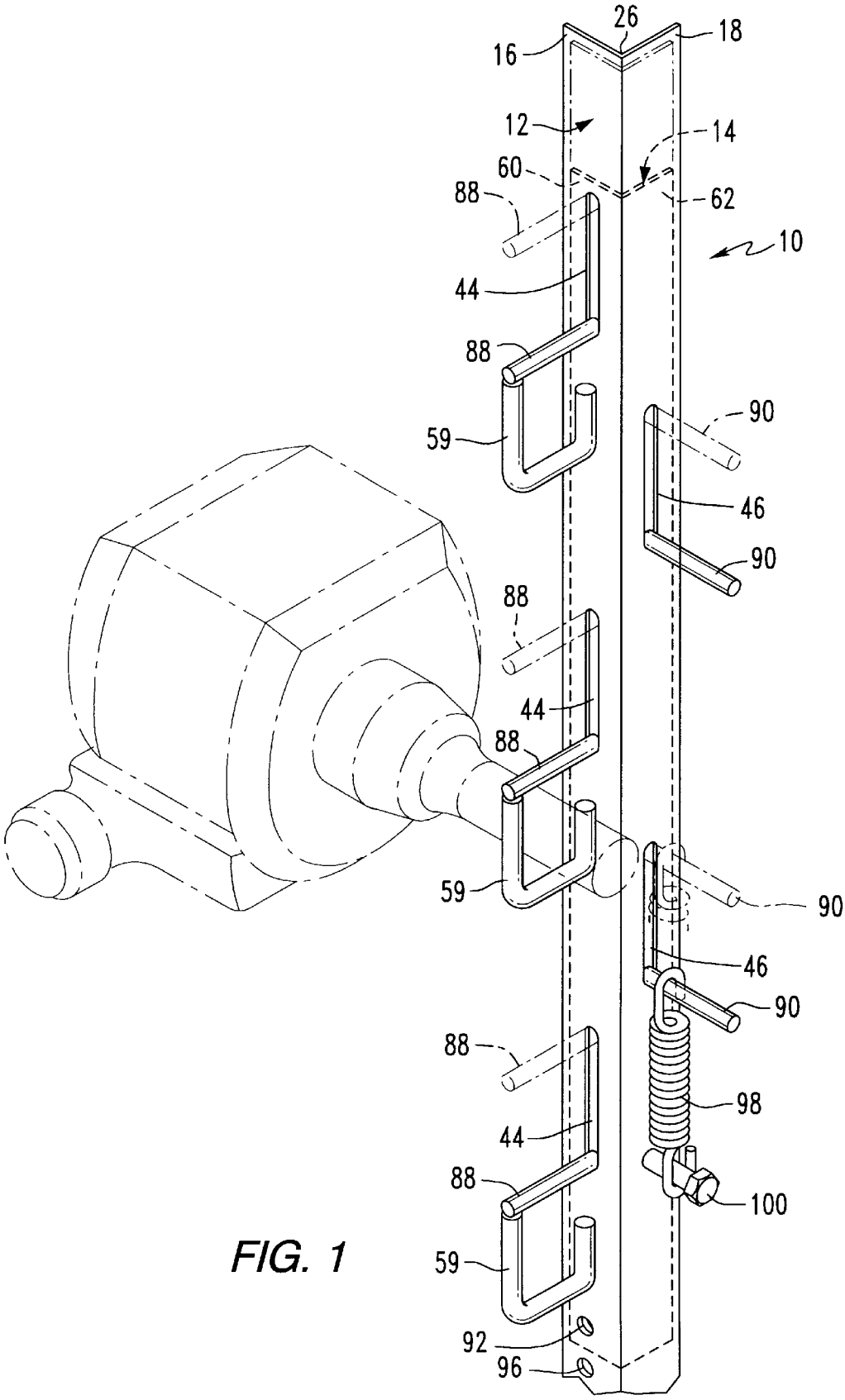
FIG. 1 is a perspective view of the rack stand herein disclosed showing the rack in a closed position and wherein the open position of the rack is shown in phantom lines.

The disclosed holder incorporates the use of two identical rack stands 10 of the type shown and described in connection with FIGS. 1–4. As will be apparent to those skilled in the pertinent art, each rack stand is mounted to a convenient base according to conventional means so that each stand is vertically oriented and so that the rack stands (10) are spaced apart from each other according to the length of the article for which the rack is intended to be used. Such articles would include, for example, ladders and string trimmers or other motorized lawn tools. The disclosed rack stands are intended for use in mobile applications so that a suitable base might comprise a truck bed or a trailer frame.

Referring to FIGS. 1–4, each rack stand 10 includes an external or first member 12 that is in sliding engagement with an internal or second member 14. As more particularly shown in FIG. 2, external member 12 is formed of two plates or panels 16 and 18 that are generally rectangular in shape. Panel 16 has an inner planar surface 20 that is oppositely disposed from an outer planar surface 22. Inner surface 20 is defined by longitudinal edges 24 and 26 and also by lateral edges 28 and 30. Outer surface 22 is defined by longitudinal edges 24 and 31 and also by lateral edges 28 and 30 . Similarly, panel 18 has an inner planar surface 32 that is oppositely disposed from an outer planar surface 34. Inner surface 32 is defined by longitudinal edges 36 and 26 and also by lateral edges 40 and 42. Outer surface 34 is defined by longitudinal edges 31 and 36 and also by lateral edges 40 and 42.

Panel 16 is joined to panel 18 between longitudinal edges 26 and 31 such that inner surfaces 20 and 32 define an angle therebetween. As shown in the presently preferred embodiment, the angle included between inner surfaces 20 and 32 is substantially 90°, but other angles that are less than 180° could also be used.

Panels 16 and 18 each have at least one elongated slot 44 and 46 respectively. In the preferred embodiment, elongated slots 44 and 46 are symmetrically shaped about respective longitudinal axes 48 and 50. Each of said elongated slots 44 and 46 are defined by substantially parallel sides 52,54 and 56,58 respectively. Slots 44 and 46 are oriented within their respective panels 16 and 18 such that the longitudinal axes 48 and 50 of slots 44 and 46 are substantially parallel to the longitudinal edges 26 and 31 at the joint between panels 16 and 18.

In the example of the preferred embodiment, panel 16 of outer member 12 includes an array of three elongated slots 44*a*, 44*b* and 44*c*. Similarly, panel 18 of outer member 12 includes an array of two elongated slots 46*a* and 46*b*. However, alternative numbers of slots 44 and 46 could also be provided.

At least one support arm 59 is secured to outer planer surface 22 of panel 16 by welding or equivalent means. Support arm 59 has ends 59*a* and 59*b* that define a gap 59*c* therebetween. Support arm 59 is secured to panel 16 at a location that is adjacent to one end of slot 44 and is oriented such that gap 59*c* is open toward the adjacent slot. In the preferred embodiment, support arm 59 is in the general form of a J-hook, but other shapes of support arm 59 could also be used. Support arm 59 extends in a generally orthogonal direction from outer surface 22 of panel 16. As shown in FIG. 1, a support arm 59 is associated with each of elongated slots 44 in the array 44*a*, 44*b* and 44*c*.

Figure 3:
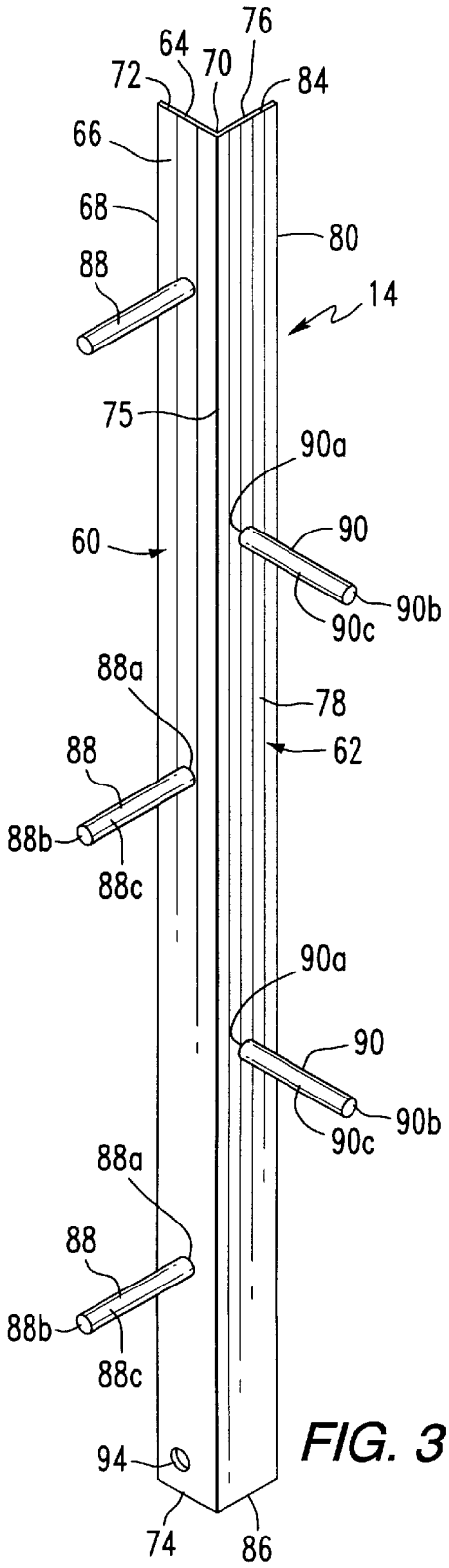
FIG. 3 is a perspective view of a second member of the rack stand shown in FIG. 1

As particularly shown in FIG. 3, internal or second member 14 is formed by two panels 60 and 62 that are also generally rectangular in shape. Panel 60 has an inner planar surface 64 that is oppositely disposed from an opposing planar surface 66. Inner surface 64 is defined by longitudinal edges 68 and 70 and also by lateral edges 72 and 74. Opposing surface 66 is defined by longitudinal edges 68 and 75 and also by lateral edges 72 and 74. Similarly, panel 62 has an inner planar surface 76 that is oppositely disposed from an opposing planar surface 78. Inner surface 76 is defined by longitudinal edges 80 and 70 and also by lateral edges 84 and 86. Opposing surface 78 is defined by longitudinal edges 80 and 75 and also by lateral edges 84 and 86.

At least one pin 88 or 90 is respectively connected to panels 60 and 62. In the example of the preferred embodiment, pins 88 and 90 are in the general shape of a right circular cylinder wherein pin 88 has ends 88*a* and 88*b* and an intermediate outer surface 88*c* located between ends 88*a* and 88*b*. Similarly, pin 90 has ends 90*a* and 90*b* and an intermediate outer surface 90*c* located between ends 90*a* and 90*b*. Alternatively, pins 88 and 90 could have non-circular cross-sectional shapes.

More specifically, pins 88 and 90 are secured to opposing surfaces 66 and 78 of panels 60 and 62 respectively such that pins 88 and 90 project from surfaces 66 and 78 in a direction that is substantially orthogonal to the respective surface. Pins 88 and 90 are secured to panels 60 and 62 by welds; permanent adhesive, or other permanent means. Where more than one pin 88 or more than one pin 90 are used, such pins are spaced longitudinally along panel 60 or 62 in correspondence with the respective spacing between slots 44 and 46 in the longitudinal direction along panel 60 or 62 such that in the assembled rack stand, pins 88 extend through respective slots 44, and pins 90 extend through respective slots 46. Furthermore, the location of each pin 88 and 90 in its respective slot 44 and 46 correlates with a corresponding position of the other pins 88 and 90 in their respective slots. In this arrangement, when inner member 14 is moved longitudinally with respect to member 12, each pin 88 and 90 travels through its respective slot 44 and 46 and arrives at a given end of slots 44 and 46 for the same given longitudinal position of inner member 14 with respect to outer member 12.

Figure 4:
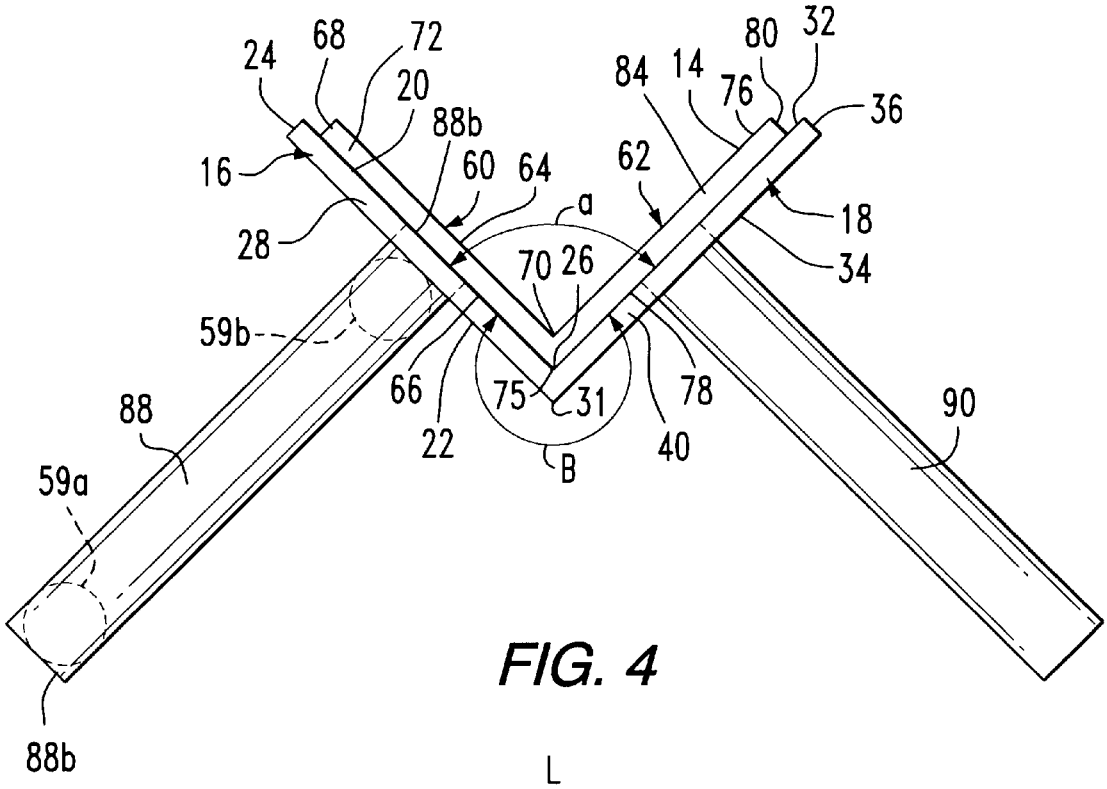
FIG. 4 is a plan view of the rack stand shown in FIG. 1.

As more specifically shown in FIGS. 1 and 4, when outer member 12 and inner member 14 are assembled together, pins 88 and 90 extend through slots 44 and 46 respectively and the longitudinal edge 26 between panels 16 and 18 of outer member 12 is aligned parallel to the longitudinal edge 75 between panels 60 and 62 of inner member 14. In this way inner member 14 is slidably moveable with respect to outer member 12 between an extreme upward position (shown in phantom lines in FIG. 1) and an extreme downward position (shown in solid lines in FIG. 1).

At times when member 14 is in the extreme upward position, pins 88 and 90 are at the upper limit of slots 44 and 46 and a gap is formed between pin 88 and the end 59*a* of support arm 59 such that articles (such as the trimmer partially illustrated in phantom in FIG. 1) can be moved into or out of the rack. With member 14 in this position, the rack is open.

At times when member 14 is in the extreme downward position, pins 88 and 90 are at the lower limit of slots 44 and 46 and pin 88 is in contact with the end 59*a* of the support arm 59. In this position, the rack stand is closed and articles cannot be taken out of the rack stand. To lock the rack stand in the closed position, outer member 12 and inner member 14 are provided with holes 92 and 94 respectively. These holes are located in their respective members such that they align when the rack stand is in the closed position. A key lock (not shown) of any commercially available type can then be inserted through holes 92 and 94 to secure the rack stand in the locked position. A second hole 96 is provided in member 12 as a convenient place to store the lock at times when the rack stand is unlocked.

In addition, a spring 98 is also provided to urge inner member 14 toward the closed position. Spring 98 has one end connected to pin 90 and the opposite end connected to an anchor 100 that is secured to member 12. The longitudinal spacing of pin 90 and anchor 100 in relation to the length of spring 98 is such that when the rack stand is in the closed position, spring 98 is in tension and pins 88 and 90 are biased against the lower ends of slots 44 and 46. In this way, when the mobile rack stand is being transported and is unlocked, spring 98 will tend to maintain the rack stand in the closed position. This will tend to avoid the loss of articles that are left in the rack stand when it is being transported and it is inadvertently left unlocked.

In accordance with the subject invention, pins 88 and 90 are located in respective panels 60 and 62 of member 14, and slots 44 and 46 are located in respective panels 16 and 18 of outer member 12 with small clearances between the lateral surfaces 88*c* and 90*c* of pins 88 and 90 and sides 52,54 and 56,58 of slots 44 and 46. Preferably, these clearances are less than 0.0625 inch. More preferably, these clearances are less than 0.03125 inch. Most preferably, these clearances are less than 0.010 inch. Surprisingly, it has been found that this close clearance allows the pins 88 and 90 to cooperate with the sides of slots 44 and 46 to maintain the rack stand in assembly without other guides, clips or fasteners. Counterintuitively, this allows the disclosed rack to actually move more freely than when the clearances are greater!

Because panels 16 and 18 and panels 60 and 62 are joined at an angle and because there is small clearance between pins 88 and 90 and sides 52,54 and 56,58, pins 88 and 90 contact sides 52,54 and 56,58 in response to movement of member 14 in a normal direction away from member 12. In this way the side surfaces 88*c* and 90*c* of pins 88 and 90 cooperate with the sides of slots 44 and 46 to maintain member 14 laterally adjacent to member 12. This arrangement of pins 88 and 90 and slots 44 and 46 thus provide an effective but mechanically simple mechanism for maintaining the rack stand in its proper assemblage.

In accordance with the foregoing, it will be seen that the engagement of pins 88 and 90 with the sides of slots 44 and 46 occurs in part due to the geometry of panels 16 and 18 and of panels 60 and 62. That is, panels 16 and 18 are in angular relationship with the angle a defined by inner surfaces 20 and 32 being less than 180 degrees. In the preferred embodiment, angle a is 90 degrees.

In a complementary manner, panels 60 and 62 of inner member 14 are also in angular relationship such that the opposing surfaces 66 and 78 of inner member 14 are substantially parallel to the inner surfaces 20 and 32 of outer member 12. In this way, inner member 14 nests inside of outer member 12 with longitudinal edge 75 of inner member 14 being guided by longitudinal edge 26 of outer member 12. To accomplish this complementary relationship, the outside angle B defined between opposing surfaces 66 and 78 is substantially 360 degrees minus a. The example of the preferred embodiment, angle B is substantially 270 degrees. Other angles for a and B could also be used, but if angle a is obtuse, the disclosed mechanism for retaining the rack stand in assemblage will be less effective.

Figure 2:
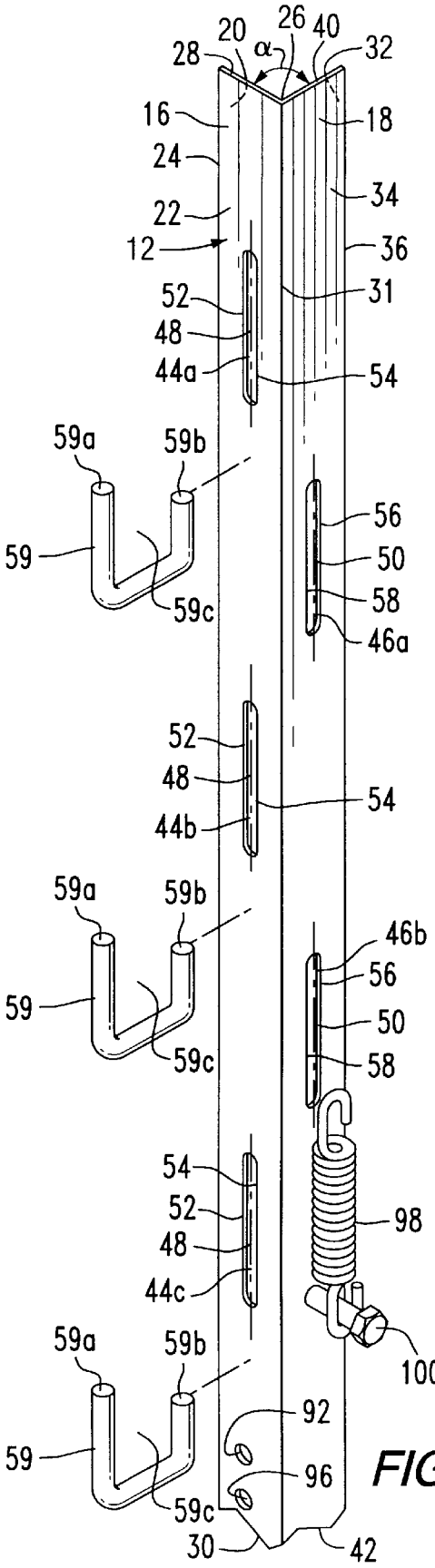
FIG. 2 is a perspective view of a first member of the rack stand shown in FIG. 1.

The mechanism for retaining outer member 12 in assemblage with inner member 14 requires that the structure herein disclosed must be assembled in a novel way. Specifically, the manufacture of outer member 14 as shown in FIG. 2 is first completed, including the machining of slots 44 and 46 and the welding of support arms 59 to member 12. Then one of pins 88 or 90 are welded to member 14. Next, member 14 is placed adjacent to member 12 with inner surfaces 20 and 32 facing opposing surfaces 66 and 78 respectively as shown in FIGS. 1 and 4 by inserting pins 88 through slots 44 (or alternatively by inserting pins 90 through slots 46 if pins 90 have been welded to member 14 instead of pins 88). Then the remaining pins (88 or 90) are inserted through the respective slots (44 or 46) and those pins are welded to inner member 14.

This method of assembly provides a novel product in that there are no clamps, guides or other fittings needed to maintain members 12 and 14 together. This important advantage has been found to make the disclosed rack stand less expensive and easier to assemble. Surprisingly, it has also made the disclosed rack stand easier to operate because there are fewer contact points at which the sliding members 12 and 14 can become bound or jammed.

Figure 6:
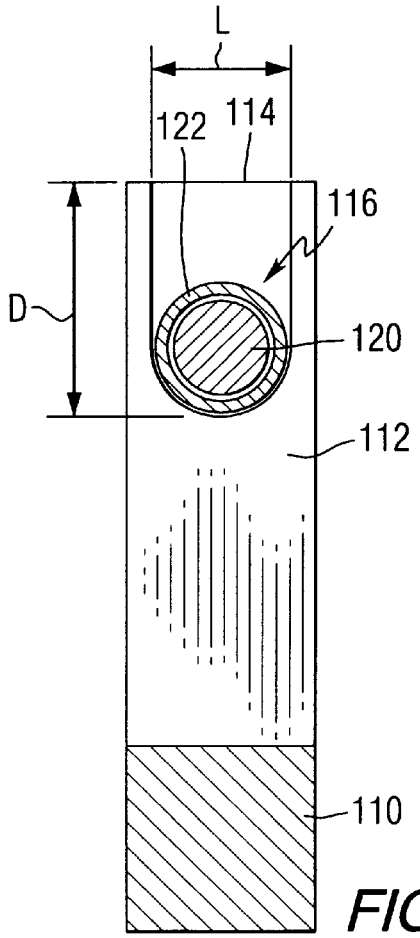
FIG. 6 is a sectional view of the support arm shown in FIG. 5 taken along the lines VI—VI.
Figure 5:
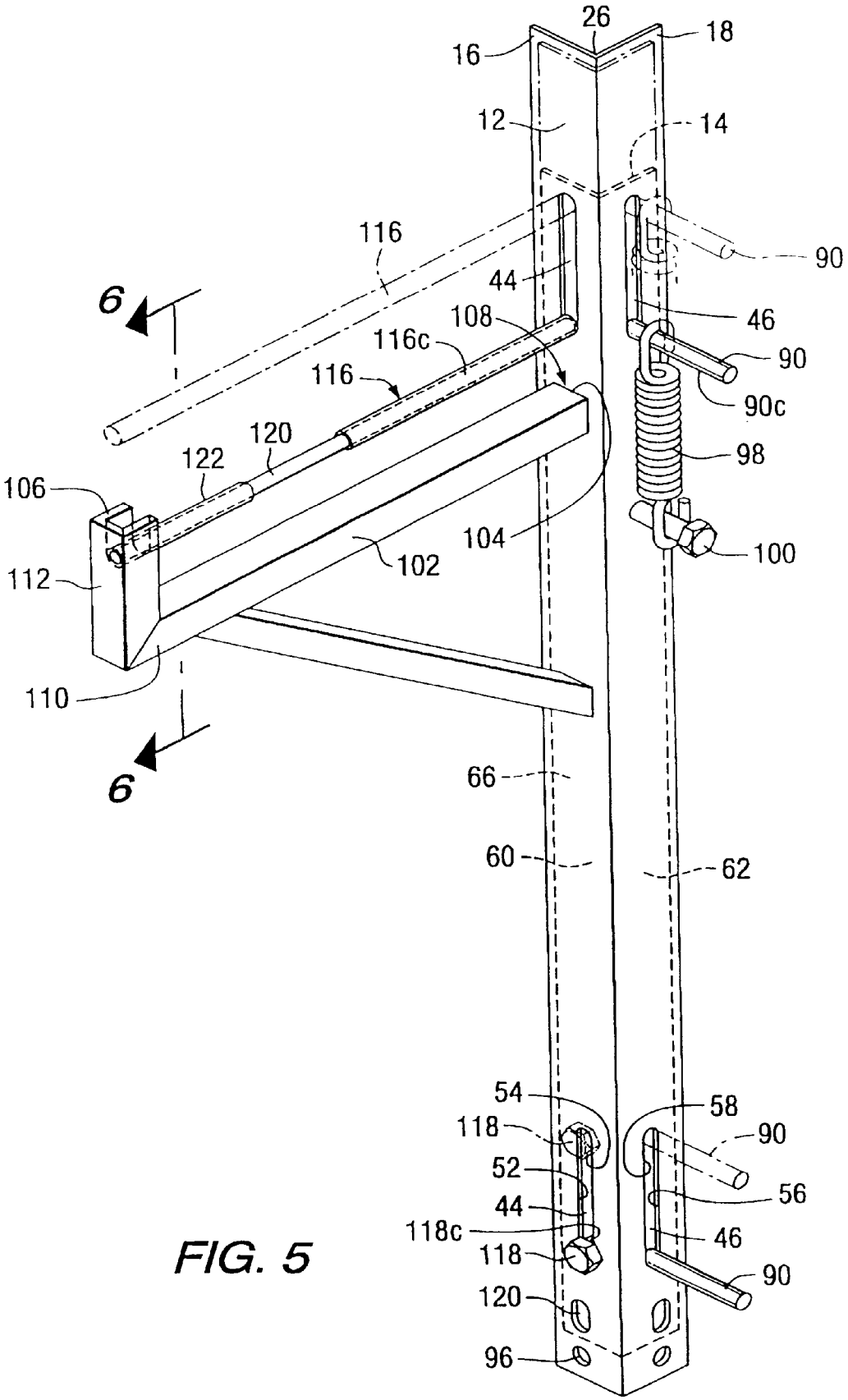
FIG. 5 is a perspective view of an alternative embodiment of the rack stand shown in FIGS. 1–4 wherein a modified form of the support arm is shown and portions of pin 116 are broken away to better disclose the structure thereof.

FIGS. 5 and 6 depict an alternative embodiment wherein parts that are similar to the embodiment of FIGS. 1–4 are identified by like reference numbers. Briefly, in the embodiment of FIGS. 5 and 6, external member 12 having panels 16 and 18 is in sliding engagement with an internal member 14. Panels 16 and 18 have elongated slots 44 and 46.

A support arm 102 is secured to outer planar surface 22 of panel 16 by welding or equivalent means. Support arm 102 has ends 104 and 106 that define a gap 108 therebetween. Support arm 102 is secured to panel 16 at a location that is at a predetermined distance from one end of slot 44 and is oriented such that gap 108 is open toward said slot. In FIGS. 5 and 6, support arm 102 includes a base 110 that is connected to a tip 112. Support arm 102 is in the general form of an L-shape with base 110 extending in a generally orthogonal direction from outer surface 22 of panel 16. Support arm 102 includes tip 112 that extends substantially orthogonally with respect to base 110 and longitudinally in or parallel to the direction of related slot 44. Tip 112 includes a notch or groove 114 that is laterally dimensioned to receive the tip of a pin 116 as is hereafter more fully explained.

In FIG. 5, internal member 14 has panels 60 and 62 with pins 90 connected to panel 62. Also in FIG. 5, pins 116 and 118 are secured to opposing surface 66 of panel 60 such that pins 116 and 118 project from surface 66 in a substantially orthogonal direction. Pin 116 is comprised of a rod 120 and a concentrically fitted pipe or sheath 122. Rod 120 is secured to panel 60 by a weld or other permanent means. Sheath 122 is also welded or otherwise permanently secured to panel 60. The combination of rod 120 with sheath 122 has been found to be advantageous in that the pin 116 that is formed by the combination thereof is stronger than rod 120 alone so that pin 116 resists bending. Pin 118 comprises a hex bolt or stove bolt that is threadingly engaged or welded to panel 60.

Pins 116 and 118 are spaced longitudinally along panel 60 in correspondence with the respective spacing between slots 44 in the longitudinal direction along panel 16 such that in the assembled rack stand, pins 116 and 118 extend through respective slots 44. Furthermore, the location of each pin 116 or 118 in its respective slot 44 correlates with a corresponding position of the other pin 116 or 118 in its respective slot. Accordingly, when inner member 14 is moved longitudinally with respect to member 12, each pin 90, 116 and 118 travels through its respective slot 46 and 44 and arrives at a given end of slot 46 or 44 for the same given longitudinal position of inner member 14 with respect to outer member 12.

As shown in FIG. 5, when outer member 12 and inner member 14 are assembled together, pins 90, 116 and 118 extend through slots 46 and 44 respectively and the longitudinal edge 26 between panels 16 and 18 of outer member 12 is aligned parallel to the longitudinal edge 75 between panels 60 and 62 of inner member 14. In this way inner member 14 is slidably moveable with respect to outer member 12 between an extreme upward position (shown in phantom lines in FIG. 5) and an extreme downward position (shown in solid lines in FIG. 5).

At times when member 14 is in the extreme upward position, pins 90, 116 and 118 are at the upper limit of slots 46 and 44 and a gap is formed between pin 116 and the end 106 of support arm 102 such that articles (particularly in this case a ladder) can be moved into or out of the rack by placing or removing the same from support arm 102. With member 14 in this position, the rack is open.

At times when member 14 is in the extreme downward position, pins 90, 116 and 118 are at the lower limit of slots 46 and 44 and pin 116 is in contact with the end 106 of support arm 102. More particularly, the tip of pin 116 is received in groove 114 of tip 112. In this position, the rack stand is closed and articles cannot be taken out of the rack stand.

In addition, a spring 98 is also provided to urge inner member 14 toward the closed position. Spring 98 has one end connected to pin 90 and the opposite end connected to an anchor 100 that is secured to member 12. The longitudinal spacing of pin 90 and anchor 100 in relation to the length of spring 98 is such that when the rack stand is in the closed position, spring 98 is in tension and pins 90, 116 and 118 are biased against the lower ends of slots 46 and 44. In this way, when the mobile rack stand is being transported and is unlocked, spring 98 will urge the rack stand in the closed position. This will tend to avoid the loss of articles that are left in the rack stand when it is being transported and it is inadvertently left unlocked.

Groove 114 is laterally dimensioned (L) in correspondence with the outside diameter of pin 116 such that the tip or distal end of pin 116 is received in groove 114. Base 110 and tip 112 of support arm 102 are sized in accordance with the dimensions of the largest articles that will be stored on base 110. For example, if the disclosed rack stand is designed for use with ladders having side rails of various thicknesses, base 110 and tip 112 are sized with tip 112 having a longitudinal dimension longer than the width of the widest ladder side rails so that pin 116 is received in groove 114 while spring 98 urges pin 116 against the ladder side rail. Groove 114 is longitudinally dimensioned (D) in accordance with the dimensions of the smallest or thinnest articles that will be stored on base 110. For example, if the disclosed rack stand is designed for use with ladders having side rails of various thicknesses, groove 114 is dimensioned long enough (i.e., D is long enough) to allow the tip of pin 116 to travel through groove 114 until pin 116 impinges on the ladder with the narrowest side rail. Thus, when ladders with the narrowest rails are supported on support arm 102, spring 98 urges pin 116 toward base 110 and pin 116 travels through groove 114 until pin 116 impinges on the ladder side rail with pin 116 in groove 114.

To lock the rack stand in the closed position, outer member 12 and inner member 14 are provided with slot 120 and hole 94 respectively. Slot 120 and hole 94 are located in their respective members such that they align when the rack stand is in the closed position with pin 116 in groove 114. The longitudinal extent of slot 120 is determined in accordance with the size range of the articles to be stored. In this way, the rack stand can be locked in the closed position with respect to all articles within such range. For example, slot 120 allows sufficient movement of member 12 with respect to member 14 so that the rack stand can be locked when a ladder with wide side rails is stored and also when a ladder with narrow side rails is stored. Since the tip of pin 116 is within groove 114 for both rail widths, the rack stand is locked with spring 98 urging pin 116 against the side rail in either case. A key lock (not shown) of any commercially available type can then be inserted through slot 120 and hole 94 to secure the rack stand in the locked position. A second hole 96 is provided in member 12 as a convenient place to store the lock at times when the rack stand is unlocked.

Pins 90, 116 and 118 are located in respective panels 62 and 60 of member 14, and slots 46 and 44 are located in respective panels 18 and 16 of outer member 12 with small clearances between the lateral surfaces 90*c*, 116*c* and 118*c* of pins 90, 116 and 118 and sides 56,58 and 52,54 of slots 46 and 44. Preferably, these clearances are less than 0.0625 inch. More preferably, these clearances are less than 0.03125 inch. Most preferably, these clearances are less than 0.010 inch. This close clearance allows the pins 90, 116 and 118 to cooperate with the sides of slots 46 and 44 to maintain the rack stand in assembly without other guides, clips or fasteners.

Because panels 16 and 18 and panels 60 and 62 are joined at an angle and because there is small clearance between pins 90, 116 and 118 and sides 56,58 and 52,54, pins 90, 116 and 118 contact sides 56,58 and 52,54 in response to movement of member 14 in a normal direction away from member 12. In this way the side surfaces 90*c*, 116*c* and 118*c* of pins 90, 116 and 118 cooperate with the sides of slots 46 and 44 to maintain member 14 laterally adjacent to member 12. This arrangement of pins 90, 116 and 118 and slots 46 and 44 thus provides an effective but mechanically simple mechanism for maintaining the rack stand in its proper assemblage.

While several presently preferred embodiments of the invention disclosed herein have been shown and described, the invention is not limited thereby, but may be otherwise variously embodied within the scope of the following claims.

What is claimed is:

1. A rack for holding elongated articles, said rack having at least first and second stands, each of said stands comprising:

a first member having first and second rectangular plates that are joined together along a longitudinal edge of each of said plates, said plates having respective outer surfaces and also having respective inner surfaces that define a first angle therebetween, each of said plates also defining at least one elongated slot that has a longitudinal axis, said elongated slot being oriented within said plate such that the longitudinal axis of said slot is substantially parallel to the longitudinal edge between said plates;

at least one support arm secured to the outer surface of the first plate of said first member, said support arm being secured to said plate at a location adjacent to one end of said slot, said support arm extending in a generally orthogonal direction from the surface of said first plate;

a second member having first and second rectangular plates that are joined together along a longitudinal edge of said plates, said plates having respective opposing surfaces that define an outside angle, where said outside angle is substantially 360° minus said first angle;

a first pin having first and second ends and a lateral surface between said first and second ends, said first pin extending through a slot of the first plate of said first member with the first end of said first pin being secured to the opposing surface of the first rectangular plate of said second member, said first pin cooperating with the support arm that corresponds to the same slot of the first plate through which the first pin extends, said first pin defining a gap between the first pin and the support arm at times when said first pin is in one position in said slot, and also closing the gap between the first pin and the support arm at times when said first pin is at a second position in said slot; and a second pin that has first and second ends and a lateral surface between said first and second ends, said second pin extending through the slot of said second plate of said first member, one end of said second pin being secured to the opposing surface of the second plate of said second member, said first and second pins contacting the edges of said first and second slots in response to movement of said first member in an orthogonal direction with respect to said second member such that the lateral surfaces of said first and second pins cooperate with the sides of the first and second slots respectively to maintain said first member laterally adjacent to said second member and to allow movement of said second member in a longitudinal direction with respect to said first member.

2. The rack stand of claim 1 wherein the first plate of said first member includes an array of two or more slots, each slot having a longitudinal axis that is substantially aligned with the longitudinal edge between said first and second plates of said first member, and wherein a pin extends through each of said slots with one end of each pin respectively connected to the first plate of said second member.

3. The rack stand of claim 1 wherein the second plate of said first member includes an array of two or more slots, each slot having a longitudinal axis that is substantially aligned with the longitudinal edge between said first and second plates of said first member, and wherein a pin extends through each of said longitudinal slots with one end of each pin respectively connected to the second plate of said second member.

4. The rack stand of claim 1 wherein said support arm has first and second oppositely disposed ends, the first end of said support arm being secured to the outer surface of the first panel of said first member at a location on the outer surface of said panel that is a predetermined distance from one end of said slot, the second end of said support arm having a recessed groove; and wherein said first pin that cooperates with said support arm is received in the recessed groove of said support arm at times when said first pin is at the second position in said slot.

5. The rack stand of claim 4 wherein said first pin further comprises:

an inner rod that has first and second ends with one end of said rod being secured to the first panel of said second member; and an outer sleeve that concentrically surrounds said inner rod such that the inner rod travels through said sleeve, said sleeve having a first end that is attached to the first panel of said second member, said sleeve also having a second end that is located adjacent to the second end of said inner rod, the second end of said sleeve being received in the recessed groove of said support arm at times when said first pin is located at the second position in said slot.

6. A rack stand comprising:

a first member that includes a first rectangular panel having oppositely disposed longitudinal edges and that also includes a second rectangular panel having oppositely disposed longitudinal edges, said first and second panels being joined together along one of said longitudinal edges and cooperating to define an angle of less than 180° between said first and second panels, said first panel having at least one elongated slot and said second panel also having at least one elongated slot;

at least one support arm that is secured to one of said first and second panels of said first member at a location on said panel that is adjacent to one end of said slot;

a second member that includes a first substantially rectangular panel having oppositely disposed longitudinal edges and a second substantially rectangular panel that also has oppositely disposed longitudinal edges, said first and second panels being joined along one of said longitudinal edges such that said panels define an external angle that is substantially equal to 360° minus the included angle defined by the panels of said first member;

a first pin having first and second ends, said first pin extending through said at least one slot in the first panel of said first member, one end of said pin being secured to the first panel of said second member, said first pin cooperating with the support arm that corresponds to the same slot of the first panel through which the first pin extends, said first pin forming a gap between the first pin and the support arm at times when said first pin is in one position in said slot, and also closing the gap between the first pin and the support arm at times when said first pin is at a second position in said slot; and a second pin inserted through said at least one slot in the second panel of said first member while the first pin extends through said at least one slot of said first panel of said first member and after one end of said first pin is secured to said second member, one end of said second pin being thereafter secured to the second panel of said second member, said first and second pins being adjacent to the sides of the respective slots through which said first and second pins extend such that movement of said first member laterally apart from said second member causes the side surface of said first and second pins to engage the peripheral sides of said first and second slots to oppose movement of the first panel laterally away from said second panel.

7. The rack stand of claim 6 wherein said support arm has first and second oppositely disposed ends, the first end of said support arm being secured to the outer surface of the first panel of said first member at a location on the outer surface of said panel that is a predetermined distance from one end of said slot, the second end of said support arm having a recessed groove; and wherein said first pin that cooperates with said support arm is received in the recessed groove of said support arm at times when said first pin is at the second position in said slot.

8. The rack stand of claim 7 wherein said first pin further comprises:

an inner rod that has first and second ends with one end of said rod being secured to the first panel of said second member; and an outer sleeve that concentrically surrounds said inner rod such that the inner rod travels through said sleeve, said sleeve having a first end that is attached to the first panel of said second member, said sleeve also having a second end that is located adjacent to the second end of said inner rod, the second end of said sleeve being received in the recessed groove of said support arm at times when said first pin is located at the second position in said slot.

9. A rack stand comprising:

a first member that includes a first rectangular panel having oppositely disposed longitudinal edges and that also includes a second rectangular panel having oppositely disposed longitudinal edges, said first and second panels being joined together along one of said longitudinal edges and cooperating to define an angle of less than 180° between said first and second panels, said first panel having at least one elongated slot and said second panel also having at least one elongated slot;

at least one support arm secured to the first panel of said first member at a location on said panel that is adjacent to one end of said slot;

a second member that includes a first substantially rectangular panel having oppositely disposed longitudinal edges and a second substantially rectangular panel that also has oppositely disposed longitudinal edges, said first and second panels being joined along one of said longitudinal edges such that said panels define an external angle that is substantially equal to 360° minus the included angle defined by the panels of said first member;

a first pin having first and second ends, said first pin extending through said at least one slot in the first panel of said first member, one end of said pin being secured to the first panel of said second member, said first pin cooperating with the support arm that corresponds to the same slot of the first panel through which the first pin extends, said first pin forming a gap between the first pin and the support arm at times when said first pin is in one position in said slot, and also closing the gap between the first pin and the support arm at times when said first pin is at a second position in said slot; and a second pin that is inserted through said at least one slot in the second panel of said first member while the first pin extends through said at least one slot of said first panel of said first member and after one end of said first pin is secured to the said second member, one end of said second pin being thereafter secured to the second panel of said second member, said first and second pins being adjacent to the sides of the respective slots through which said first and second pins extend such that movement of said first member laterally apart from said second member causes the side surface of said first and second pins to engage the peripheral sides of said first and second slots to oppose movement of the first panel laterally away from said second panel.

10. The rack stand of claim 9 wherein the gap between the sides of the slots and the lateral surface of respective pins in said slots is less than 0.03125 inch.

11. The rack stand of claim 9 wherein the gap between the sides of the slots and the lateral surface of respective pins in said slots is less than 0.010 inch.

12. The rack stand of claim 9 wherein the gap between the sides of the slots and the lateral surface of respective pins in said slots is less than 0.0625 inch.

13. The rack stand of claim 12 wherein said first and second pins are welded to the outer face of the first and second panels of the second member.

14. The rack stand of claim 12 wherein said first and second pins have a generally cylindrical shape.

15. The rack stand of claim 12 wherein said first and second pins are oriented in a substantially orthogonal direction with respect to the first and second panels of said second member.

16. The rack stand of claim 12 wherein said support arm has first and second oppositely disposed ends, the first end of said support arm being secured to the outer surface of the first panel of said first member at a location on the outer surface of said panel that is a predetermined distance from one end of said slot, the second end of said support arm having a recessed groove; and wherein said first pin that cooperates with said support arm is received in the recessed groove of said support arm at times when said first pin is at the second position in said slot.

17. The rack stand of claim 16 wherein said first pin further comprises:

an inner rod that has first and second ends with one end of said rod being secured to the first panel of said second member; and an outer sleeve that concentrically surrounds said inner rod such that the inner rod travels through said sleeve, said sleeve having a first end that is attached to the first panel of said second member, said sleeve also having a second end that is located adjacent to the second end of said inner rod, the second end of said sleeve being received in the recessed groove of said support arm at times when said first pin is located at the second position in said slot.

18. A rack stand comprising:

a first member that includes a first rectangular panel having oppositely disposed inner and outer surfaces that are defined between two longitudinal edges, said first member also including a second rectangular panel having oppositely disposed inner and outer surfaces that are defined between two longitudinal edges, said first and second panels being joined together at one longitudinal edge thereof and cooperating to define an angle of less than 180° between the inner surfaces said first and second panels, said first panel having at least one elongated slot that is centered on a longitudinal axis that is of substantially constant lateral diameter at points along said longitudinal axis and said second panel also having at least one elongated slot that is located on a longitudinal axis and that has a substantially constant lateral diameter at points along said longitudinal axis;

at least one support arm secured to the outer surface of the first panel of said first member at a location on the outer surface of said panel that is adjacent to one end of said slot;

a second member that includes a first generally rectangular panel having oppositely disposed inner and outer surfaces defined between two longitudinal edges, said second member also including a second generally rectangular panel having oppositely disposed inner and outer surfaces defined between two longitudinal edges, said first panel being joined to said second panel along one of said longitudinal edges such that the outer surfaces of said panels define an external angle that is substantially equal to 360° minus the included angle defined by the panels of said first member;

a first pin having a lateral surface defined between first and second ends, said first pin extending through the slot in the first panel of said first member with one end of said pin being secured to the outer face of the first panel of said second member; and a second pin having a lateral surface defined between first and second ends, said second pin being inserted through said at least one slot in the second panel of said first member while the first pin extends through said at least one slot of said first panel of said first member and one end of said first pin is secured to the outer face of said second member, one end of said second pin being thereafter secured to the outer face of the second panel of said second member, the sides of said at least one slot in said first panel respectively cooperating with the lateral surface of said first pin to define a gap therebetween of less than 0.010 inch, and the sides of said slots in said second panel respectively cooperating with the lateral surface of said second pin to define a gap therebetween of less than 0.010 inch such that movement of said first member laterally away from said second member causes the side surfaces of said first and second pins to engage the sides of said first and second slots to oppose movement of the first panel laterally away from said second panel.

19. A rack stand for holding elongated articles, said rack stand made in accordance with the method comprising:

providing at least one elongated slot in each panel of a first member having first and second rectangular panels that are joined along a longitudinal edge to define an angle between said panels;

attaching at least one support arm to one panel of said first member, said support arm being attached to said panel at a location that is adjacent to one end of the elongated slot of said panel;

securing at least one pin to a second member having first and second rectangular panels that are joined along a longitudinal side to define an outside angle wherein said outside angle is substantially 360° minus the inside angle defined between the panels of the first member;

inserting the distal end of at least one pin that is secured to the first panel of said second member through an elongated slot formed in the first panel of said first member and aligning the edge formed by the panels of the first member substantially parallel to the edge formed by the panels of the second member;

inserting one end of a second pin through the elongated slot formed in the second panel of said first member; and attaching the end of the second pin that has been inserted through the elongated slot formed in the second panel of said first member to the second panel of said second member when the first pin is extending through the elongated slot in the first panel of said first member.

* * * * *